US005887448A

United States Patent [19]

Gilbert et al.

[11] Patent Number: 5,887,448

[45] Date of Patent: Mar. 30, 1999

[54] TOY JEWELRY KIT WITH ASSEMBLY WORK STATIONS

[75] Inventors: Truman J. Gilbert, Philadelphia, Pa.; Mary Ellen G. Fosbenner, Riverton, N.J.; Lisa A. Gilde, Philadelphia, Pa.; Ernest D. Baker, Jr., Medford, N.J.

[73] Assignee: Mattel, Inc., El Segundo, Calif.

[21] Appl. No.: 914,451

[22] Filed: Aug. 19, 1997

[51] Int. Cl.[6] ..... A44C 13/00

[52] U.S. Cl. ..... 63/1.16; 63/3; 63/15; 63/29.1; 29/896.4; 29/896.411; 29/896.412

[58] Field of Search ..... 29/896.4, 896.41, 29/896.411, 896.412; 63/1.16, 3, 3.1, 15, 29.1

[56] References Cited

U.S. PATENT DOCUMENTS

| | | | |
|---|---|---|---|
| 839,047 | 12/1906 | Sylvester | 63/3 X |
| 1,550,191 | 8/1925 | Werner | 29/896.41 X |
| 1,613,595 | 1/1927 | Abel | 29/896.4 X |
| 1,796,387 | 3/1931 | Mountford | 29/896.41 X |
| 2,119,039 | 5/1938 | Boyd | 63/15 |
| 2,738,616 | 3/1956 | Windle . | |
| 3,336,427 | 8/1967 | Hanson | 29/896.41 X |
| 3,509,734 | 5/1970 | Lederer . | |
| 3,682,603 | 8/1972 | Pompeo | 29/896.41 X |
| 3,805,549 | 4/1974 | Nielsen | 63/15 X |
| 3,826,493 | 7/1974 | Pethick . | |
| 4,208,888 | 6/1980 | Erdman et al. | 63/33 |
| 4,305,262 | 12/1981 | Ferrara . | |
| 4,309,879 | 1/1982 | Gretz et al. . | |
| 4,317,337 | 3/1982 | Walden et al. . | |
| 4,761,972 | 8/1988 | Falcone | 29/896.41 X |
| 4,768,688 | 9/1988 | Harrigan | 63/3 X |
| 4,794,766 | 1/1989 | Schunk et al. . | |
| 4,827,575 | 5/1989 | Delaney | 63/29.1 X |
| 4,977,757 | 12/1990 | Mesica et al. . | |
| 5,119,641 | 6/1992 | Terry . | |
| 5,138,855 | 8/1992 | Faris | 63/3.1 X |
| 5,343,608 | 9/1994 | MacDonald . | |
| 5,351,378 | 10/1994 | Hsien-Chung | 29/896.4 X |
| 5,355,698 | 10/1994 | Edmark | 63/29.1 |
| 5,404,731 | 4/1995 | Traub . | |
| 5,456,095 | 10/1995 | Tawil et al. . | |
| 5,640,859 | 6/1997 | Fromm . | |
| 5,782,107 | 7/1998 | Glanz | 63/3 |

OTHER PUBLICATIONS

Playtime® Catalog, Tyco Toys, Inc., Mt. Laurel, N.J., 1993, cover and p. 48.

*Primary Examiner*—Kenneth J. Dorner
*Assistant Examiner*—Andrea Chop
*Attorney, Agent, or Firm*—Panitch Schwarze Jacobs & Nadel, P.C.

[57] ABSTRACT

A toy kit includes a ring base, a ring gem and/or a ring dome, and preferably a plurality of each component. A first work station for assembling a toy ring base with either a toy ring gem or a toy ring dome includes a base and an upright support structure attached to the base. A ram is movably mounted to the support structure so as to move between a most distal position with respect to the base and a most proximal position with respect to the base. The toy kit further includes a hollow, flexible tube having at least one open end, a particulate substance sized to pass within the open end of the tube and a liquid substance, and preferably a plurality of each. A second toy work station for assembling the tube with particulate or liquid substances includes a base and an upright support structure attached to the base and having a passage sized to accommodate particulates. A carriage is movably mounted to the support structure and has a holder configured to receive and retain the tube. A linkage is connected with the carriage so as to move the carriage to displace the holder alternately toward and away from the passage of the support structure. After particulates and/or liquids are inserted into the tube, a continuous loop simulating a piece of jewelry is formed by inserting a connector into both ends of the tube.

16 Claims, 3 Drawing Sheets

TOY JEWELRY KIT WITH ASSEMBLY WORK STATIONS

BACKGROUND OF THE INVENTION

The present invention relates to toy jewelry kits and, more specifically, to toy jewelry kits having one or more work stations for assembling together jewelry components.

Toy kits have recently become an important aspect of the toy industry. Such kits provide children with the opportunity to both make and use toy articles. Toy kits therefor have the added benefits of providing a child with a sense of accomplishment and teaching the child to make and use handicrafts.

It would be desirable to provide a toy kit that will allow young children, particularly young girls, to fabricate jewelry of a sufficient quality to be worn.

BRIEF SUMMARY OF THE INVENTION

In a first aspect, the present invention is a toy kit comprising a ring base and one of a ring gem and a ring dome. A first work station is configured to assemble a selected one of the ring gem and the ring dome to the ring base. The toy kit further includes a hollow, flexible tube having at least one open end, a particulate substance sized to pass within the open end and a liquid substance. A second work station is configured to receive and retain the tube and having a passage configured to direct any selected one of the particulate substance and the liquid substance into the open end of the tube.

In a second aspect, the present invention is also a toy work station for assembling a hollow, flexible tube having at least one open end with another toy component. The work station comprises a base, an upright support structure attached to the base, the support structure including a passage sized to accommodate the second component. A carriage is movably mounted to the support structure, the carriage having a holder configured to receive and retain the tube. A linkage is connected with the carriage so as to move the carriage to displace the holder alternately toward and away from the passage of the support structure.

In a third aspect, the present invention is also a toy work station for assembling at least a toy ring base with one of a toy ring gem and a toy ring dome. The work station comprises a base, an upright support structure attached to the base and a ram movably mounted to the support structure so as to move between a most distal position with respect to the base and a most proximal position with respect to the base.

In a fourth aspect, the present invention is also a toy workshop comprising a first toy work station for assembling at least a toy ring base with one of a toy ring gem and a toy ring dome. The first toy work station includes a base, an upright support structure attached to the base and a ram movably disposed within the housing so as to move between a most distal position with respect to the base and a most proximal position with respect to the base. A second toy work station for assembling a hollow, flexible tube having at least one open end with another toy component includes a base and an upright support structure attached to the base, the housing including a passage sized to accommodate the second component. A carriage is movably mounted to the support structure, the carriage having a holder configured to receive and retain the tube. A linkage is connected with the carriage so as to move the carriage to displace the holder alternately toward and away from the passage of the support structure.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings, which are diagrammatic, embodiments which are presently preferred. It should be understood, however, that the invention is not limited to the precise arrangements and instrumentalities shown. In the drawings.

DETAILED DESCRIPTION OF THE INVENTION

Figure 1:
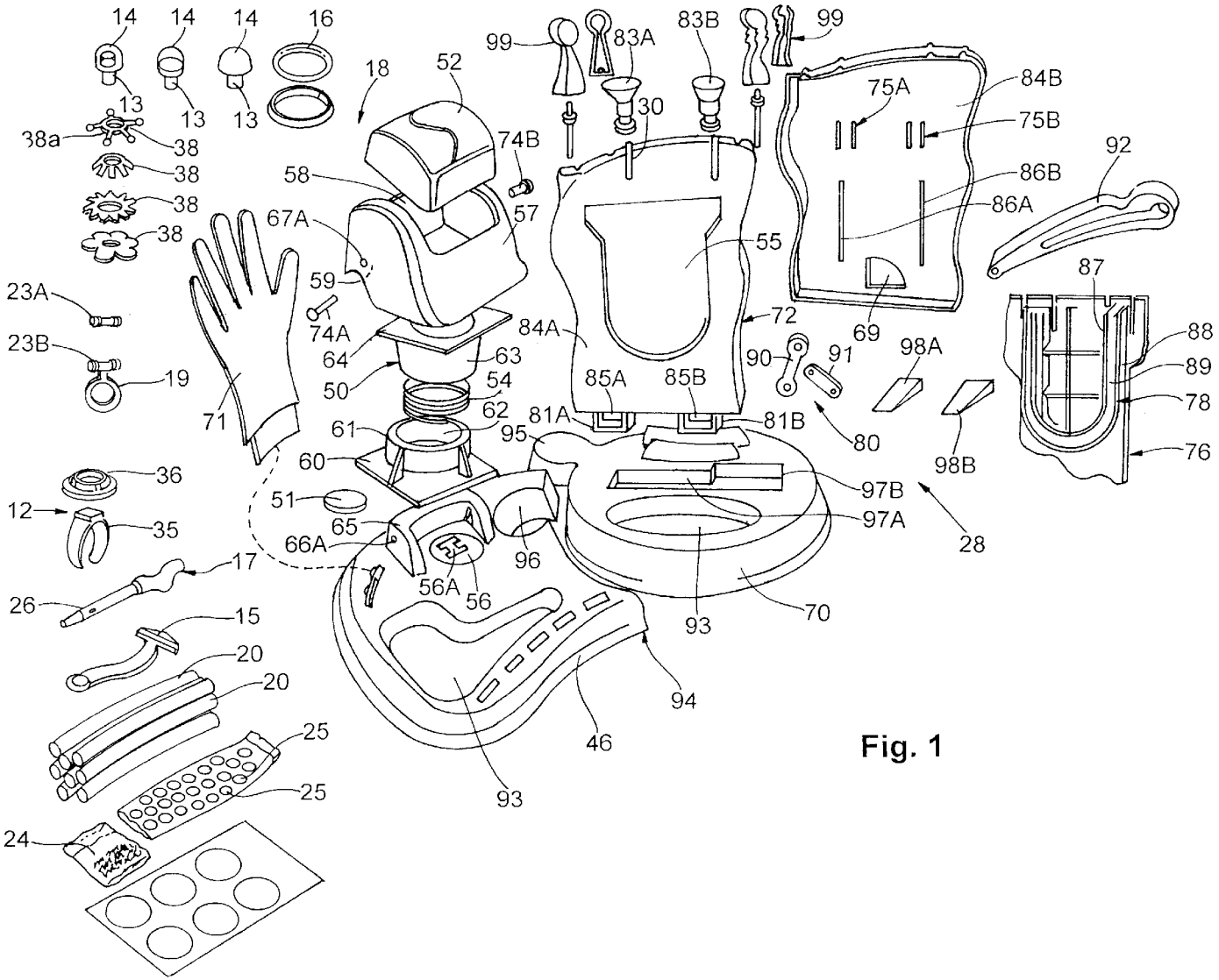
FIG. 1 is an exploded view of a toy kit in accordance with the present invention.

Certain terminology is used in the following description for convenience only and is not limiting. The words "right", "left", "lower", "upper", "upward", "down", "downward" designate directions in the drawings to which reference is made. Further, the words "front", "frontward", and "rear", "rearward" refer to directions toward and away from, respectively, the designated front portion of each respective work station. The terminology includes the words above specifically mentioned, derivatives thereof, and words of similar import.

Referring now to the drawings in detail, wherein like numerals are used to indicate like elements throughout, there is shown in FIGS. 1–4 a presently preferred embodiment of the toy jewelry kit 10. The toy jewelry kit 10 basically comprises a ring bases 12, one of a ring gem 14 and a ring domes 16, and a first work station 18 configured to assemble a selected one of the ring gem 14 and the ring dome 16 to the ring base 12. The toy kit 10 further comprises a hollow, flexible tube 20 having at least one open end 22A, one of a particulate substance 24 sized to pass within the open end 22A and a liquid substance 26, and a second work station 28 configured to receive and retain the tube 20 and having a passage 30 configured to direct any selected one of the particulate substances 24 and the liquid substances 26 into the open end 22A of the tube 20.

Figure 2:
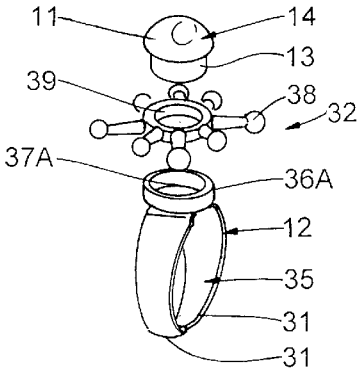
FIG. 2 is an exploded view of a first ring assembly.
Figure 3:
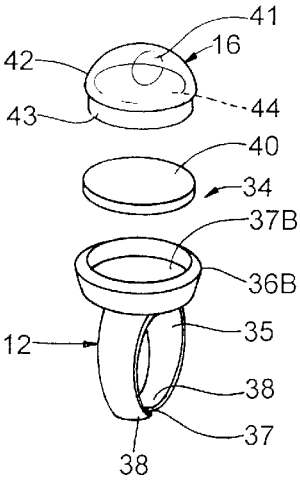
FIG. 3 is an exploded view of a second ring assembly.

Referring now to FIGS. 1–3, the toy kit 10 preferably includes a plurality of ring bases 12, ring gems 14, and ring domes 16, so as to construct a number of first ring assemblies 32 (FIG. 2) or second ring assemblies 34 (FIG. 3). Each ring assembly 32, 34 includes a ring base 12 formed of a ring band 35 and a circular fitting 36A or 36B attached to an outer surface of the ring band 35. Preferably, the ring base 12 used with the second ring assembly 34 has a fitting 36B with an inner diameter larger than the inner diameter of the fitting 36A used with the first ring assembly 32, so as to accommodate the larger ring dome 16. However, it is within the scope of the present invention to construct all the ring bases 12 identically and to configure the gems 14 and domes 16 appropriately. Preferably, the ring band 35 of either ring assembly 32 or 34 is adjustable by providing a separation gap in a portion of the band 35 so that the ring band 35 has two ends 31 which are movable so as to accommodate various finger sizes.

Referring particularly to FIG. 2, the first ring assembly 32 includes a ring gem 14, which is a simulated gem, having a lower cylindrical portion 13. The kit 10 further comprises a decorative skirt 38, preferably a plurality of skirts 38, configured to be mounted to the ring base 12 and disposed about the ring gem 14. Each decorative skirt 38 has a circular through hole 39 extending through the center of the skirt 38. When assembled as described below, the cylindrical portion 13 of the ring gem 14 extends through the through hole 39 of the decorative skirt 38 and into the opening 37A in the circular fitting 36A. The cylindrical portion 13 of the ring gem 14 is maintained within the opening 37A of the fitting 36A by friction, so that the decorative skirt 38 is trapped between the upper portion of the gem 14 and the upper surface of the fitting 36A. The decorative skirt 38 can alternatively be sized to fit over the fitting 36A, so that the skirt 38 is attached to the ring base 12 by friction between the inner surface of the through hole 39 of the skirt 38 and the outer cylindrical surface of the fitting 36A and/or is retained by interference with the upper portion of the ring gem 14 and with the ring band 35.

Alternatively, the skirt 38 can be functional and used to join a ring gem 14 and a ring base 12. The skirt 38 can include a lip 38*a* (FIG. 1) configured to fit within the opening 37A of the fitting 36A and is maintained therein by friction. The cylindrical portion 13 of the ring gem 14 extends into the through hole 39 through the skirt 38, so that the gem 14 is attached to the ring base 12 by friction between inner surface of the through hole 39 and the cylindrical portion 13. A second alternative skirt (not shown) that is also functional is configured to fit over the fitting 36A, so as that the skirt is attached to the ring base 12 by friction between the outer cylindrical surface of the fitting 36A and the inner surface of the through hole of the skirt. With the second alternative fitting, the cylindrical portion 13 of the ring gem 14 extends into an upper portion of the through hole, so that the gem 14 is attached to the ring base 12 by friction between the cylindrical portion 13 and the inner surface of the through hole of the skirt.

Referring particularly to FIG. 3, the second ring assembly 34 further includes at least a base disk 40 and may also include a decorative object 41. The disk 40 is sized to fit within and seat across the circular opening 37B of a fitting 36B so as to form a platform extending across the inside of the fitting 36B. The ring dome 16 has an upper hemispherical portion 42 and a lower cylindrical wall 43, the wall 43 preferably having a uniform diameter less than the largest diameter of the hemispherical portion 42. Preferably, the ring dome 41 is formed of a transparent material and has a hollow interior portion 44 sized to accommodate one or more decorative objects 41. When assembled as described below, the base disk 40 is disposed within the fitting 36B in the manner described above and the cylindrical wall 43 of the ring dome 16 extends into the opening 37B of the fitting 36B and rests upon the disk 40 and is maintained in the opening 37B by friction. The dome 16 traps the disk 40 within the fitting 36B and maintains any decorative objects 41 within the hollow interior 44.

Figure 4:
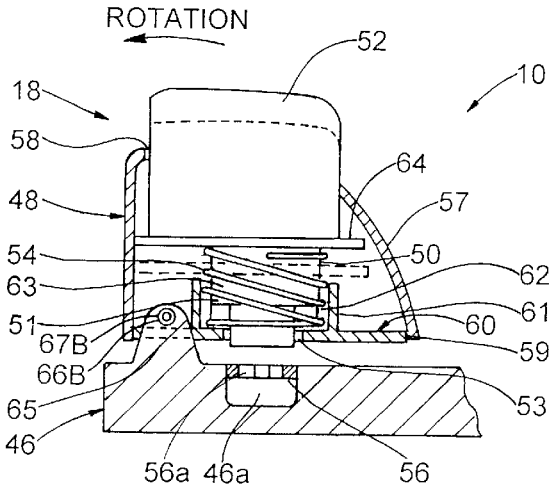
FIG. 4 is a cross-sectional view of a first work station.

Referring now to FIGS. 1 and 4, the first toy work station 18 for assembling together the ring assemblies 32, 34 described above comprises a base portion 46, an upright support structure 48 attached to the base portion 46, and a ram 50 movably mounted to the support structure 48 so as to move between a most distal position with respect to the base (solid lines in FIG. 4) and a most proximal position with respect to the base (dashed line in FIG. 4). Preferably, the support structure 48 is a housing and the ram 50 is disposed within the housing 48. The housing 48 includes a hollow rectangular box 57 having an upper opening 58 and a lower opening 59. Preferably, the housing 48 further includes a base portion 60 having a through hole 53 and a circular guide wall 61 forming a well 62 in which at least a lower portion of the ram 50 is disposed so as to be guided by the guide wall 61.

Further, the ram 50 is preferably formed of a cylindrical portion 63 attached to an upper rectangular plate 64 and has a pad 51 attached to the lower end of the cylindrical portion 63. The work station 18 further comprises a spring 54 connected with the ram 50 to bias the ram 50 toward the most distal position (solid lines in FIG. 4), as described above. The spring 54 is disposed about the cylindrical portion 63 of the ram 50, with at least the lower end of the cylindrical portion 63 being disposed within the well 62, such that the spring 54 is located at least partially inside the well 62 and "trapped" between the upper surface of the base wall 60 and the lower surface of the rectangular plate 64.

Still referring to FIGS. 1 and 4, the workstation 18 further comprises a handle 52 disposed at least partially within the housing 48 and connected to the ram 50. The handle 52 is configured to manually actuate the ram 50 to the most proximal position described above. Preferably, the handle 52 is a rectangular block extending through the upper opening 58 of the housing 48 and resting upon the upper surface of the rectangular plate 64 and is guided by the edges of the upper opening 58. The first work station 18 further comprises a ring holder 56 in the base portion 46 configured to receive and retain one or more ring bases 12. The ring holder 56 is preferably a round plate having an opening 56*a* which allows the band 35 of a ring base 12 to pass through the plate and be disposed in a cavity 46*a* in the base portion 46, while supporting the fitting 36A or 36B of the ring base 12 above the upper surface of the base portion 46. Preferably, the base portion 46 further includes a mounting portion 65 that includes pivot openings 66A, 66B extending through opposite lateral sides thereof and two pivot pins 74A, 74B that extend into the openings 67A, 67B in the box portion 57 of the housing 48 and into the pivot opening 66A, 66B, respectively, to rotatably attach the housing 48 (and attached components) to the base portion 46. The housing 48 is rotatable about the mounting portion 65 so as to move between the "closed" position shown in FIG. 4 in a direction generally away from the base portion 46 (as indicated by the arrow) to an "open" position (not shown), and vice-versa. Preferably, the first work station 18 further includes a simulated hand 71, providing fingers on which ring assemblies 32, 34 can be stored and/or displayed.

Referring particularly to FIG. 4, by pushing downward on the handle 52, the handle 52 moves downwardly within the upper opening 58 and pushes against the rectangular plate 64 of the ram 50. The ram 50 is pushed downwardly such that the cylindrical portion 63 moves downwardly within the well 62 along the sides of the guide wall 61, while compressing the spring 54, to move the pad 51 downwardly through the through hole 53 to a position proximal to the ring holder 56 (as shown dashed in FIG. 4). When the handle 52 is released with the ram 50 disposed in the downwardmost position, the spring 54 pushes upwardly against the rectangular plate 64 to move the cylindrical portion 63 of the ram 50 upwardly along the guide wall 61, causing the rectangular plate 64 to push the handle 52 to an initial position extending furthest outwardly from the housing 48.

Although the structure of the first work station 18 depicted in FIGS. 1 and 4 and described above is preferred, it is within the scope of the present invention to construct the first work station 18 in any other appropriate manner that enables the work station 18 to assemble a ring gem 14 and/or ring dome 16 to a ring base 12. For example, the first work station 18 can be configured as an open frame support structure having a linkage or gearing mechanism connecting a ram to the frame and moving the ram between two positions, with a lever or crank-handle actuating the mechanism (none shown). Further for example, the ram 50 be can be a rectangular solid attached to an upper portion of the housing 48 by extension springs, with the housing 48 having guide slots at opposing ends of the ram 50 and constructed without a guide block (none shown) and/or the housing 48 can be slidable upwardly/downwardly from the base portion 46 in a sub-frame (not shown) instead of being rotatable, with the remaining components of the work station 18 being constructed generally as described above. The present invention is intended to embrace these and any other alternative constructions of the first work station 18 that are capable of assembling the components of the ring assemblies 32, 34.

Figure 5:
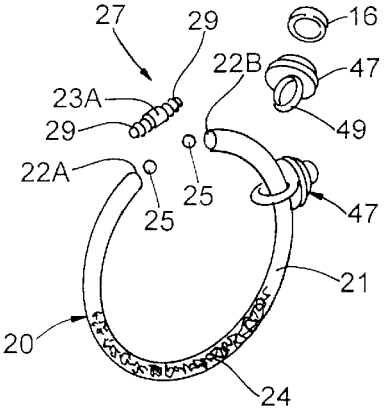
FIG. 5 is an exploded view of a bracelet assembly.

Referring now to FIGS. 1 and 5, the toy kit 10 preferably includes a plurality of hollow flexible, transparent tubes 20, preferably formed of a plurality of different colors and/or clear, and a plurality of different particulate substances 24. The toy kit 10 may also include a plurality of different liquid substances or powdered substances (not shown) for mixing with tap water to form liquids of various colors, or a user may use ordinary tap water as a liquid substance 26. Each tube 20 has two open ends 22A, 22B and a hollow interior portion 21. When a particulate and/or liquid substance 24, 26, respectively has been inserted within the hollow interior portion 21 of the tube 20 in the manner described below, a decorative effect is provided by the particulate substance 24 and/or by either a colored liquid substance 26 or by the color of the material of the tube 20 itself.

Further, the toy kit 10 includes a plurality of end closures 25 each formed as a spherical plug, as shown in FIGS. 1 and 5, or alternatively as a cylindrical plug (not shown). The end closures 25 are inserted into the open ends 22A, 22B of a tube 20 to seal the ends 22A, 22B of the tube 20, particularly when a particulate or liquid substance 24, 26, respectively, has been inserted into the hollow interior portion 21 of the tube 20, as described below. The toy kit 10 further comprises a connector 23A or 23B, and preferably a plurality of connectors 23A, 23B configured to join the two ends 22A, 22B of the tube 20 so as to form a continuous loop simulating a piece of jewelry, such as a bracelet, anklet or necklace, hereinafter collectively referred to as a bracelet assembly 27. Each connector 23A and 23B is preferably formed as a cylinder having two inwardly-stepped ends 29, each end 29 being sized to fit within an open end 22A, 22B of a tube 20. Each connector 23B further includes a charm portion 19, as shown in FIG. 1, into which can be assembled charm components (not shown), preferably similar to the components of the ring assemblies 32, 34, or the charm portion 19 can be utilized as a plain hoop-like charm without any other components.

Further, each bracelet assembly 27 can include one or more charms 47 that are substantially similar to either the dome ring assemblies 34 (as shown in FIG. 5) or gem ring assemblies 32 (not shown), except that the charms 47 have a closed loop 49 in place of the adjustable ring band 35. The charms 47 are attached to a bracelet assembly 27 by sliding the tube 20 through the loop 49 before the ends 22A, 22B are joined by a connector 23, as described in further detail below. Furthermore, the particulate substances 24 and the liquid substances 26 are preferably packaged in an appropriate containers, such as sealable tubes, jars or plastic bags. Preferably, the particulate substance 24 is the flaky material commonly known as "glitter", most preferably provided in a variety of colors. However, any other appropriate particulate substance can be used, such as for example, small beads (not shown), as long as the substance is sized to pass within the open ends 22A, 22B of a tube 20. Further, although the liquid substance 26 is preferably user-supplied tap water, liquid substances 26 that are alternatively provided with the kit 10 are preferably water with different colorings added, although any other appropriate liquid can also be used. Furthermore, the toy kit 10 may include one or more "scoops" 15 for handling particulate substances 24 and eye-droppers 17 for handling liquid substances 26.

Figure 6:
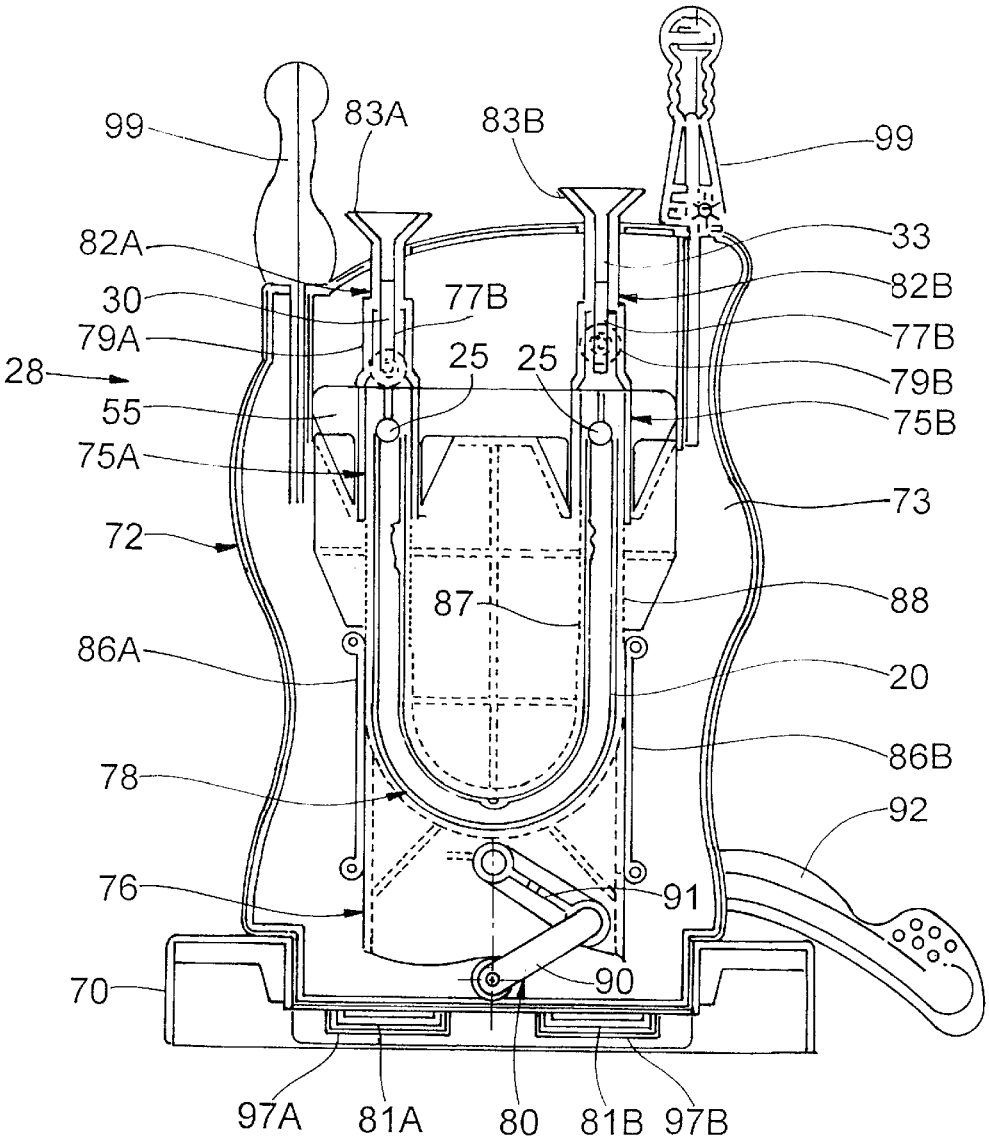
FIG. 6 is a front plan view of a second work station shown in FIG. 1.
Figure 7:
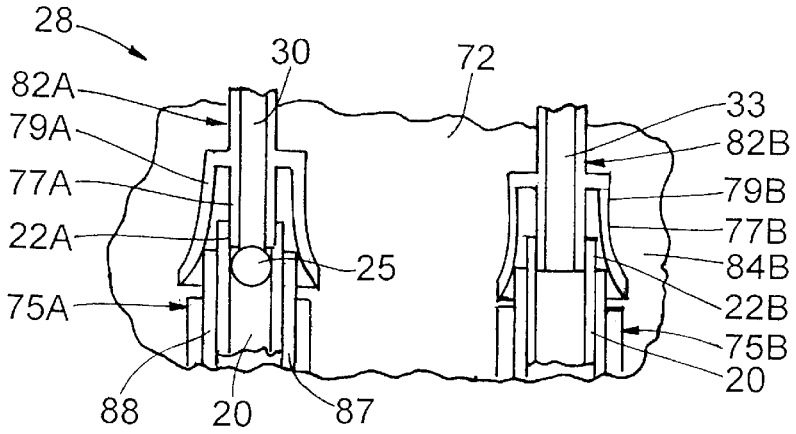
FIG. 7 is an enlarged, broken-away view of the work station of FIG. 6 showing the holder in a second position, one-half showing an insertion operation.

Referring to FIGS. 1 and 6–7, the second work station 28 for assembling the bracelet assemblies 27 basically comprises a base portion 70 and an upright support structure 72 attached to the base portion 70 and having the passage 30, which is sized to accommodate the particulate substances 24 and the liquid substances 26. A carriage 76 is movably mounted to the support structure 72, the carriage 76 having a holder 78 configured to receive and retain the tube 20. A linkage 80 is connected with the carriage 76 so as to move the carriage 76 to displace the holder 78 alternately toward and away from the passage 30 of the support structure 72. The work station 28 is configured such that the open end 22A or 22B of a tube 20 retained in the holder 78 is positioned proximal to and aligned with the passage 30 in the housing 72 when the holder 78 is in a most proximal position with respect to the passage 30.

Preferably, the upright support structure 72 is a box-like housing constructed of two shell halves 84A, 84B assembled together so as to enclose a hollow interior portion 73 in which is disposed the carriage 76. The first shell half 84A includes an access opening 55 through which the tube 20 and end closures 25 are placed into the holder 78. Further, the first shell half 84A also includes two spaced-apart locking tabs 81A, 81B extending from a lower end thereof which are configured to fit within matching openings 97A, 97B into the upper surface of the base portion 70. When the tabs 81A, 81B are fitted within the respective openings 97A, 97B, locking wedges 98A, 98B are inserted into openings 85A, 85B in the tabs 81A, 81B, respectively, to secure the housing (and thus the second work station 28) to the base portion 70. The second shell half 84B includes two vertically extending and spaced-apart guide rails 86B, 86B between which is disposed the carriage 76, so that the outer edges of the carriage 76 slide against the inner surfaces of the guide rails 86A, 86B. Furthermore, the second shell half 84B also includes two pairs of spaced-apart and vertically-extending guide walls 75A, 75B, which align the upper end of the holder 78, and thus the ends 22A, 22B of the tube 20, with the passages 30, 33, as described below.

Preferably, the work station 28 comprises a hollow shaft 82A forming the passage 30 and a funnel 83A attached to an upper end of the shaft 82A, with the shaft 82A extending through an upper end of the support structure 72. Further, the support structure or housing 72 includes a second passage 33 located with respect to the first passage 30 such that a tube 20 having the two open ends 22A, 22B and retained in the holder 78 is positioned with each open end 22A, 22B disposed proximal to and aligned with a separate passage 30, 33, respectively, when the holder 78 is at the most proximal position. The second passage 33 is also formed of a hollow shaft 82B and a funnel 83B. Preferably, the second work station 28 includes two plungers 99 configured to slide into and through the passages 30, 33 of the shafts 82A, 82B and into the open ends 22A, 22B of the tube 20, so as to push any residual particulate substances 24 out of the passages 30, 33 and into the tube 20 in the manner of a pipe cleaner.

Preferably, as shown in FIGS. 6 and 7, each shaft 82A, 82B has a lower coaxial section formed by an inner tube portion 77A, 77B and an outer tube portion 79A, 79B, the outer tube portion 79A, 79B having an outwardly flared lip and the inner tube portion 77A, 77B being configured to insert an end closure 25 within the open end 22A or 22B of a tube 20. In other words, when the holder 78 is in the most proximal position to the passages 30, 33, the ends 22A, 22B of the tube 20 enter through the flared ends of the outer tube portions 79A, 79B, respectively, of the shafts 82A, 82B and continue upwardly so that the inner tube portions 77A, 77B slide into the open ends 22A, 22B, respectively, of the tube 20, as shown in FIG. 7.

Referring to FIGS. 1 and 6, the carriage 76 is preferably a generally flat and rectangular member sized to fit between the guide rails 86A, 86B on the second shell half 84B. The holder 78 is preferably formed by inner and outer U-shaped walls 87, 88, respectively, that extend from a common vertical surface of the carriage 76 with the shorter wall 87 being encircled by the longer wall 88 such that a U-shaped channel 89 is formed between the walls 87, 88. The upper ends of the U-shaped walls 87, 88 fit within and slide along the pairs of guide walls 75A, 75B of the first shell half 84A, as best shown in FIG. 6, so as to align the ends 22A, 22B of a tube 20 with the passages 30, 33 respectively.

Still referring to FIGS. 1 and 6, the linkage 80 is basically formed of a first link 90, a second link 91, and a lever 92. The first link 90 has a lower end attached to the housing 72 and an upper end rotatably attached to the lower end of the second link 91 The second link 91 has an upper end attached to the carriage 76. The lever 92 is attached to a pin (not shown) that extends from the upper end of the first link 90 and through an opening 69 in the second shell half 84B, the lever 92 being configured to rotate the first link 90 with respect to the housing 72.

Referring particularly to FIG. 6, when the lever 92 is in the position shown in FIG. 6 and is pulled upwardly, the lever 92 causes the first link 90 to rotate about the pivot fixed to the housing 72 in an upward direction. The first link 90 pushes upwardly on the second link 91 so that the second link 91 both rotates and moves upwardly, thereby pushing the carriage 76 upwardly between the two guide rails 86A, 86B. When the lever 92 is in the upward position (not shown) and is pushed downwardly, the first link 90 is rotated downwardly, pulling the second link 91 and the carriage 76 downwardly. The arrangement of the linkage 80 and the carriage 76 is such that the two components function as slider-crank mechanism.

Although the structure of the second work station 28 depicted in FIGS. 1, 6 and 7 and described above is preferred, it is within the scope of the present invention to construct the second work station 28 in any other manner that enables the station 28 to fill a tube 20 with particulate and/or liquid substances 24, 26, respectively, and/or to seal the ends 22A, 22B of the tube 20. For example, the second work station 28 could be constructed with a lower, stationary tube-holder portion and a movable upper portion (neither shown), the upper portion including the passages 30, 33 and configured to move the passages 30, 33 toward and away from the tube 20. Further for example, the upright support structure 72 can be an open frame, the linkage 80 can be replaced by a handle attached to the carriage 76 and means to lock the carriage 76 in the proximal position, such as by "locking" the handle into a slot, and/or the shafts 82A, 82B can be single-walled tubes (none shown), with the remaining components of the work station 28 being constructed generally as described above. The present invention is intended to embrace these and any other alternative constructions of the second work station 28 that are useful to assist a user in assembling the components of the bracelet assembly 27.

Referring again to FIG. 1, the toy kit 10 further comprises a system base 94 supporting the first and second work stations 18, 28. The first work station 18 has a first base portion 46 with one of a projection 95 and a recess 96 and the second work station 28 has a second base portion 70 with a remaining one of the projection 95 and the recess 96. The projection 95 and the recess 96 are interlockable to join the first base portion 46 to the second base portion 70, thereby forming the system base 94. Preferably, the base portion 46 of the first work station 18 includes the recess 96 and the base portion 70 of the second work station 46 includes the projection 95, as shown in FIG. 1. With a system base 94 being formed by joining together the individual work station base portions 46, 70, the two work stations 18, 28 can either be joined together and used as a common system or can be separated and utilized as two separate work stations. Preferably, each base portion 46, 70 further includes a holding cavity 93 for storing the components of the ring assemblies 32, 34 and bracelet assemblies 27.

Preferably, the components of the first work station 18, with the exception of the spring 54 which is preferably steel, are each molded of a polymeric material, such as high impact polystyrene or polyethylene. Further, the portions of the second work station 28 in which the tube 20 is disposed, such as the carriage 76, is molded of K-resin so as to be transparent, and the other portions, such as the shell halves 84A, 84B, are molded of high impact polystyrene. The base portions 46, 70 of the work stations 18, 28 are preferably molded of high impact polystyrene or ABS. The ring gems 14 and ring domes 16 are preferably molded of ABS, the ring bands 35 are preferably press-formed of metal, and the tubes 20 are preferably a soft grade of PVC. However, those skilled in the art will recognize that other materials and processes can be used to construct the components of the toy kit 10, such as molding the ring bands 35 of a polymeric material, and the present invention is intended to embrace all other appropriate materials and/or processes for constructing the components of the toy kit 10.

Referring to FIGS. 1–4, to use the first work station to fabricate ring assemblies 32, 34, the housing 48 of the first work station 18 is first rotated generally away from base portion 46 so that the ring holder 56 is accessible to the user. A ring base 12, having either a skirt 38 and a gem 14 placed in a fitting 36A or a base disk 40 and a ring dome 41 placed in a fitting 36B, is placed in the ring holder 56 as described above. Next, the housing 48 is rotated generally toward the base portion 46 so that the ram 50 is positioned above the holder 56 (FIG. 4). Then, the user pushes downwardly on the handle 52, moving the ram 50 toward the holder 56 to the proximal position so that the pad 51 first contacts the ring gem 14 or ring dome 16 and then presses the gem 14 or dome 16 downward and into the respective fitting 36A or 36B. The handle 52 is then released so that the ram 50 moves generally away from the holder 56 by action of the spring 40. Finally, the housing 48 is again rotated generally away from the base portion 46, enabling the completed ring assembly 32 or 34 to be removed from the holder 56. The first work station 18 is also used to assemble charms 47, or charm components (not shown) to the charm portion 19 of the connector 23B, in an substantially identical manner as the fabrication of the ring assemblies 32, 34.

Referring to FIGS. 1, 5–7, to use the second work station 28 to fabricate a bracelet assembly 27, the carriage 76 with attached holder 78 is first brought, if not already so disposed, to the most distal position (FIG. 6) by pushing the lever 92 downwardly towards the base 70. A tube 20 is inserted through the access opening 55 in the housing 72 and fitted into the U-shaped channel 89 of the holder 78. The lever 92 is then pulled generally upwardly so that the linkage 80 moves the carriage 76 upwardly until the holder 78 is brought to the most proximal position (FIG. 7). The open ends 22A, 22B of the tube 20 are then disposed proximal to and aligned with the lower ends of the passages 30, 33, respectively, and preferably, the lower ends of the inner tube portions 77A, 77B, are inserted into the open ends 22A, 22B of the tube 20. Then, a particulate substance 24 can be placed within the tube 20 by pouring the particulate substance 24 into a funnel 83A, 83B of one of the passages 30, 33, respectively, so that the substance 24 travels through the passage 30 or 33 and one open end 22A or 22B and into the hollow interior portion 21 of the tube 20. Alternatively or in addition to the particulate substance 24, a liquid substance 26, such as tap water (either "plain" or mixed with a colorizing powder or dye), can placed within tube 20 by pouring the liquid 26 into a funnel 83A, 83B, preferably of the other passage 33 or 30, so that the liquid 26 flows through the passage and one open end 22A or 22B until the hollow interior portion 21 of the tube 20 is substantially filled with the liquid 26.

Next, the user pushes downwardly on the lever 92 to move the carriage 76 and attached holder 78 downwardly from the passages 30, 33. The user inserts two end closures 25 through the access opening 55 and places one end closure 25 on each open end 22A, 22B of the tube 20. The user again pulls upwardly on the lever 92 to move the tube 20 in the holder 78 toward the proximal position. As the tube 20 approaches the passages 30, 33, the lower ends of the inner tube portions 77A, 77B of each passage 30, 33, respectively, force the end closures 25 into the open ends 22A, 22B of the tube 20 (one shown in FIG. 7). The ends 22A, 22B are thereby sealed by the end closures 25 so that the particulate substance 24 and/or liquid substance 26 are maintained therein. Then, the user again moves the carriage 76 and holder 78 downward from the passages 30, 33 and removes the now-sealed tube 20 from the holder 78 through the access opening 55. One or more charms 47 can then be placed onto the sealed tube 20, if desired, by threading the tube 20 through the openings of the charms 47. Finally, the user inserts each stepped end 29 of an end connector 23A or 23B (having an integral charm portion 19) into a separate open end 22A, 22B of the tube 20 to join the ends 22A, 22B of the tube 20, thereby forming a bracelet assembly 27.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy kit comprising:

a ring base;

at least a selected one of a ring gem and a ring dome;

a first work station configured to assemble the selected one of the ring gem and the ring dome to the ring base;

a hollow, flexible tube having at least one open end;

at least a selected one of a particulate substance sized to pass within the open end and a liquid substance; and a second work station configured to receive and retain the tube and having a first passage configured to direct any selected one of the particulate substance and the liquid substance into the open end of the tube.

2. The kit as recited in claim 1 further comprising an end closure and wherein the second work station is configured to connect the end closure with the tube.

3. The kit as recited in claim 1 further comprising a connector and wherein the tube has another open end, the connector being configured to join the two ends of the tube so as to form a continuous loop simulating a piece of jewelry.

4. The kit as recited in claim 1 further comprising a decorative skirt configured to be mounted to the ring base and disposed about the ring gem.

5. The kit as recited in claim 1 further comprising a base supporting the first and second work stations.

6. The kit as recited in claim 1 wherein the first work station has a first base portion with one of a projection and a recess and the second work station has a second base portion with the other of the projection and the recess, the projection and the recess being interlockable to join the first base portion to the second base portion.

7. The kit as recited in claim 1 wherein the first work station comprises a base portion, a support structure attached to the base portion and a ram movably mounted to the support structure so as to move between a most distal position with respect to the base portion and a most proximal position with respect to the base portion.

8. The kit as recited in claim 7 wherein the first work station further comprises a handle configured to manually actuate the ram to the most proximal position and a spring connected with the ram to bias the ram toward the most distal position.

9. The kit as recited in claim 7 wherein the base portion includes a holder configured to receive and retain the ring base.

10. The kit as recited in claim 7 wherein the support structure is a housing and the ram is disposed within the housing, and the first work station further comprises a handle disposed at least partially within the housing and connected to the ram, the handle being configured to manually actuate the ram to the most proximal position, a spring connected with the ram to bias the ram toward the most distal position, a holder in the base portion configured to receive and retain the ring base.

11. The kit as recited in claim 1 wherein the second work station comprises:

a base portion;

an upright support structure attached to the base portion and having the first passage;

a carriage movably mounted to the support structure, the carriage having a holder configured to receive and retain the tube; and a linkage connected with the carriage so as to move the carriage to displace the holder alternately toward and away from the first passage of the support structure.

12. The kit as recited in claim 11 wherein the open end of the tube, when the tube is retained in the holder, is positioned proximal to and aligned with the first passage in the support structure when the holder is at a most proximal position with respect to the first passage.

13. The kit as recited in claim 11 wherein the support structure includes a second passage located with respect to the first passage such that the tube, when retained in the holder, is positioned with each open end disposed proximal to and aligned with the corresponding first or second passage when the holder is at a most proximal position with respect to the first passage.

14. The kit as recited in claim 11 further comprising a hollow shaft forming the first passage and a funnel attached to an upper end of the shaft.

15. The kit as recited in claim 11 wherein the kit further comprises an end closure and the upright support structure includes a hollow shaft forming the first passage and having an end configured to insert the end closure within the open end of the tube.

16. The kit as recited in claim 1 wherein the first work station comprises:

a base portion;

an upright support structure attached to the base portion;

a ram movably disposed within the support structure so as to move between a most distal position with respect to the base portion and a most proximal position with respect to the base portion; and the second work station comprises:

a base portion;

an upright support structure attached to the base portion of the second work station and having the first passage;

a carriage movably mounted to the support structure of the second work station, the carriage having a holder configured to receive and retain the tube; and a linkage connected with the carriage so as to move the carriage to displace the holder alternately toward and away from the first passage of the support structure of the second work station.

* * * * *